US006102614A

United States Patent [19]

Yukawa

[11] Patent Number: 6,102,614

[45] Date of Patent: Aug. 15, 2000

[54] PAVEMENT FOR AUTOMOBILE TEST COURSE

[75] Inventor: Wataru Yukawa, Tokyo, Japan

[73] Assignee: The Nippon Road Company Limited, Tokyo, Japan

[21] Appl. No.: 09/154,112

[22] Filed: Sep. 16, 1998

Related U.S. Application Data

[63] Continuation of application No. 09/154,112, Sep. 16, 1998.

[30] Foreign Application Priority Data

Aug. 7, 1998 [JP] Japan ..... 10-193426

[51] Int. Cl.[7] ..... E01C 5/00; E01C 5/04; E01C 5/22

[52] U.S. Cl. ..... 404/35; 404/73

[58] Field of Search ..... 404/17, 19, 29, 404/35, 44, 73; 14/77.1

[56] References Cited

U.S. PATENT DOCUMENTS 4,972,537 11/1990 Slaw, Sr. ..... 14/77.1
5,617,599 4/1997 Smith ..... 14/73
5,802,652 9/1998 Smith ..... 14/73

FOREIGN PATENT DOCUMENTS 0 726 361 A1 8/1996 European Pat. Off. .
5-40301 6/1993 Japan .
2539543 4/1997 Japan .

*Primary Examiner*—James A. Lisehora
*Attorney, Agent, or Firm*—McDonnell Boehnen Hulbert & Berghoff

[57] ABSTRACT

A concrete block has a first and a second hole passing through the concrete block in a vertically direction. An internal thread is formed in the first and the second hole. A plurality of tiles have a slipping resistivity. The tiles are arranged in order on an upper surface of the concrete block. The first and the second hole each have at a level of the upper surface an open region smaller than a respective tile.

2 Claims, 13 Drawing Sheets

PAVEMENT FOR AUTOMOBILE TEST COURSE

RELATED APPLICATIONS

This application is a continuation of U.S. patent application Ser. No. 09/154,112, filed Sep. 16, 1998.

BACKGROUND OF THE INVENTION

1. Field of the Invention

The present invention relates to a pavement for an automobile test course, and more particularly, to a pavement for an automobile test course which is made into a transportable unit structure.

2. Description of the Related Art

Conventionally, the test course road for automobiles is constructed such that a concrete pavement layer is formed on a base course, and tiles each having a slipping resistivity are adhered to an upper surface of the concrete pavement layer through adhesive.

However, the test course road is constructed such that the concrete pavement is paved first, and the tiles are adhered one by one on the upper surface of the concrete pavement layer. Therefore, this work takes a long time and thus it is not preferable in terms of operation efficiency. The finished surfaces are of uneven quality, and it is difficult to obtain the previously set finishing precision.

SUMMARY OF THE INVENTION

It is an object of the present invention to provide a pavement for an automobile test course in which the pavement is formed into a unit structure to facilitate a arrangement operation for temporarily arranging the unit structure in a horizontal direction to enhance the operational efficiency.

An another object is to provide a pavement in which the previously set finishing precision can be obtained.

To achieve the objects, according to the present invention, there is provided a pavement for an automobile test course, comprising: a concrete block formed into a transportable size, and provided at an upper surface thereof with a plurality of first and second through holes vertically passing through the concrete block; internal threads provided in the plurality of first and second through holes; and tiles each having a slipping resisitivity, and arranged in order on the entire upper surface of the concrete block except the first and second through holes; the first and second through holes having diameters capable of being closed by the tiles.

According to the invention, since the pavement comprises a concrete block in a form of a unit of a transportable size, the pavement can be transported to a construction site by a truck or the like, and can be paved on a test course road. Further, the tiles are previously arranged in order on the concrete block, operation for adhering the tiles one by one in the construction site is omitted. Therefore, the operation time is shortened, and the operation efficiency is enhanced.

It is preferable that the internal thread of the first through hole is screwed to an external thread of a jig for lifting the concrete block, and the internal thread of the second through hole is screwed to an external thread of a jig for adjusting a height of the concrete block.

With this feature, the external thread of the jig for adjusting the height of the concrete block is previously screwed to, passing through and projecting from, the internal thread of the second through hole of the pavement transported to the construction site. At that time, tip ends of the external threads are projected uniformly. Next, the external thread of the jig for lifting up the concrete block is screwed into the internal thread of the first through hole, the jig for lifting up the concrete block is lifted by a crane truck, and the pavement is temporarily paved on the test course road. After the pavement has been temporarily paved, the jig for lifting the concrete block is removed from the pavement. Subsequently, the external thread of the removed jig for lifting the concrete block is screwed into the internal thread of the first through hole of another pavement which is standing by, and the jig for lifting up the concrete block is lifted by the crane truck, and the operation for temporarily paving the pavement is repeatedly conducted, thereby paving the pavements sequentially. In this case, the pavement can be easily lifted without requiring the hanging operation, and is temporarily paved, the operation efficiency for temporarily paving the pavement is enhanced.

The tip end of the external thread of the jig for adjusting the height of the concrete block contacts with the road surface so that the temporarily arranged pavement is supported substantially horizontally with a space in which a filler is charged between the pavement and the road surface.

When the horizontally supported pavement is inclined after the temporary arrangement, the projecting amount of the external thread for adjusting a height of the concrete block at that inclined portion is controlled, and the inclination can be easily corrected by positioning the pavement horizontally.

Therefore, as compared with means in which the height adjusting bolt is screwed and projected until the bolt abuts against the road surface after the temporary arrangement, and the horizontal state of the pavement is secured by adjusting the projecting amount, the temporary arranging operation of the pavement is swiftly completed.

Next, after the pavements have been temporarily paved, the jig for lifting the concrete block is removed from the first through hole, and a filler such as cement is fully charged into a space formed between the freed first through hole and the road surface. After the filler has been charged and hardened, the jig for adjusting the height of the concrete block screwed to the internal thread of the second through hole is removed. Upper portions of the removed second through hole and the through hole into which the filler was charged are closed by the tiles to complete the operation. With the above operations, a test course road having a set uniform precision is obtained.

Further, according to the present invention, in order to form the pavement into a transportable unit, the pavement comprises a concrete block formed into a transportable size, and tiles each having a slipping resisitivity, and arranged in order on an entire upper surface of the concrete block.

In order to make possible to easily pave the pavement on the course road temporarily, it is preferable that the pavement further comprises a plurality of first through holes formed on a portion of an upper surface of the concrete block such as to vertically pass through the concrete block, and having diameters which can be closed by tiles instead of the tiles, and a jig provided in the first through hole for lifting up the concrete block.

Further, in order to swiftly complete the temporarily paving operation of the pavement, it is preferable that the pavement further comprises a plurality of second through holes formed on a portion of an upper surface of the concrete block such as to vertically pass through the concrete block, and having diameters which can be closed by tiles instead of the tiles, and a jig provided in the second through hole for adjusting a height of the concrete block.

DETAILED DESCRIPTION OF THE PREFERRED EMBODIMENTS

Embodiments of the present invention will be specifically explained below with reference to FIGS. 1 to 14.

Figure 1:
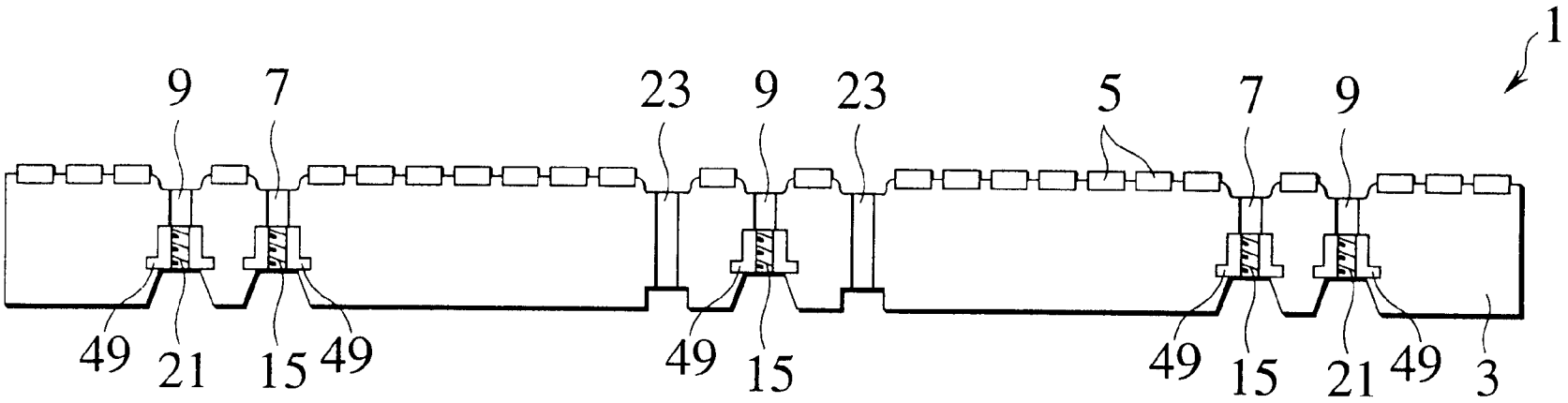
FIG. 1 is a sectional view of a pavement according to an embodiment of the present invention.

In FIG. 1, a pavement 1 is formed in a plant. The pavement 1 comprises a concrete block 3 which is long in its longitudinal direction, i.e., in a lateral direction in FIG. 1, and is formed into a unit of a transportable size. A plurality of first through holes 7 and second through holes 9 which vertically penetrate the concrete block 3 and have diameters capable of being closed by tiles 5 are arranged side by side on an upper surface of the concrete block 3. The first through holes 7 and second through holes 9 each have at a level of the upper surface an open region smaller than a respective tile 5.

Figure 2:
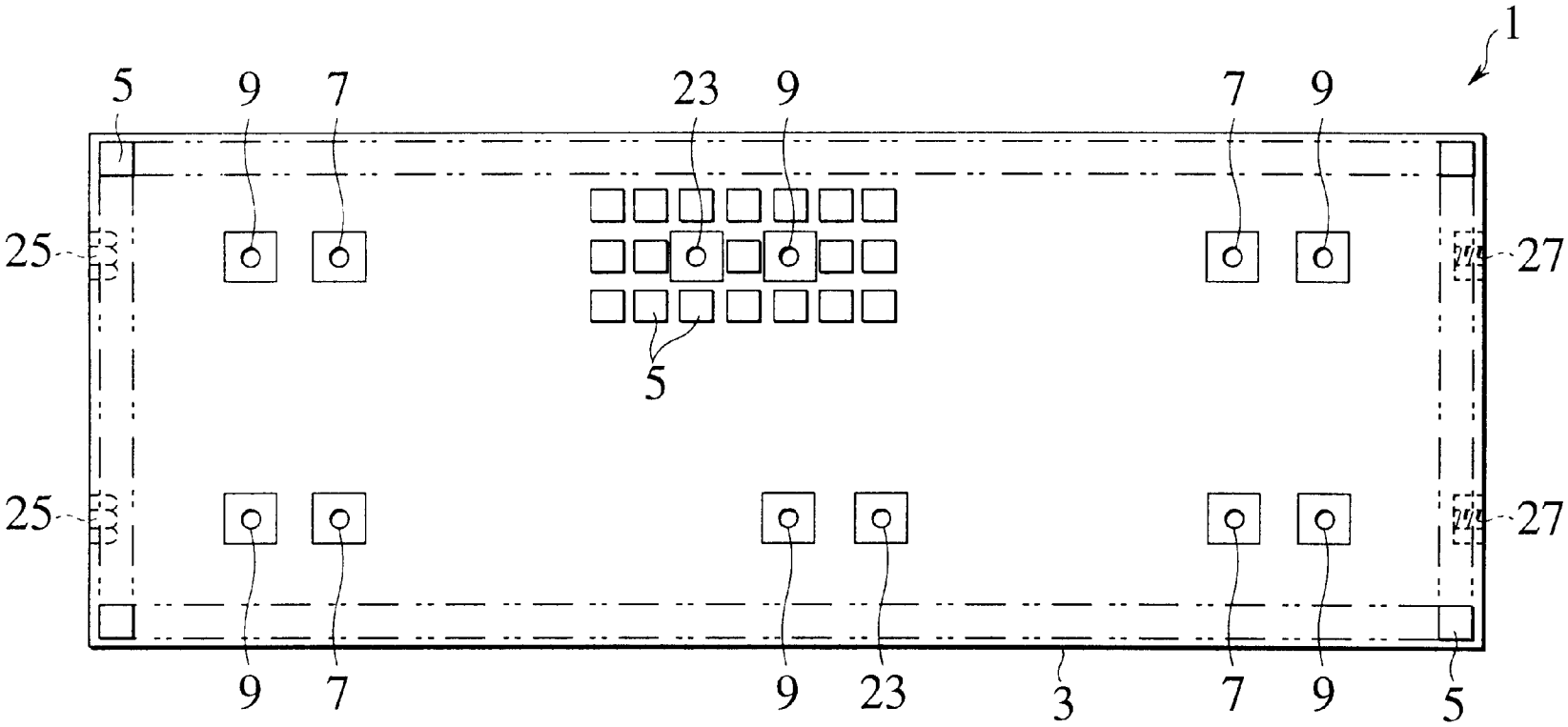
FIG. 2 is a schematic plan view in FIG. 1.
Figure 7:
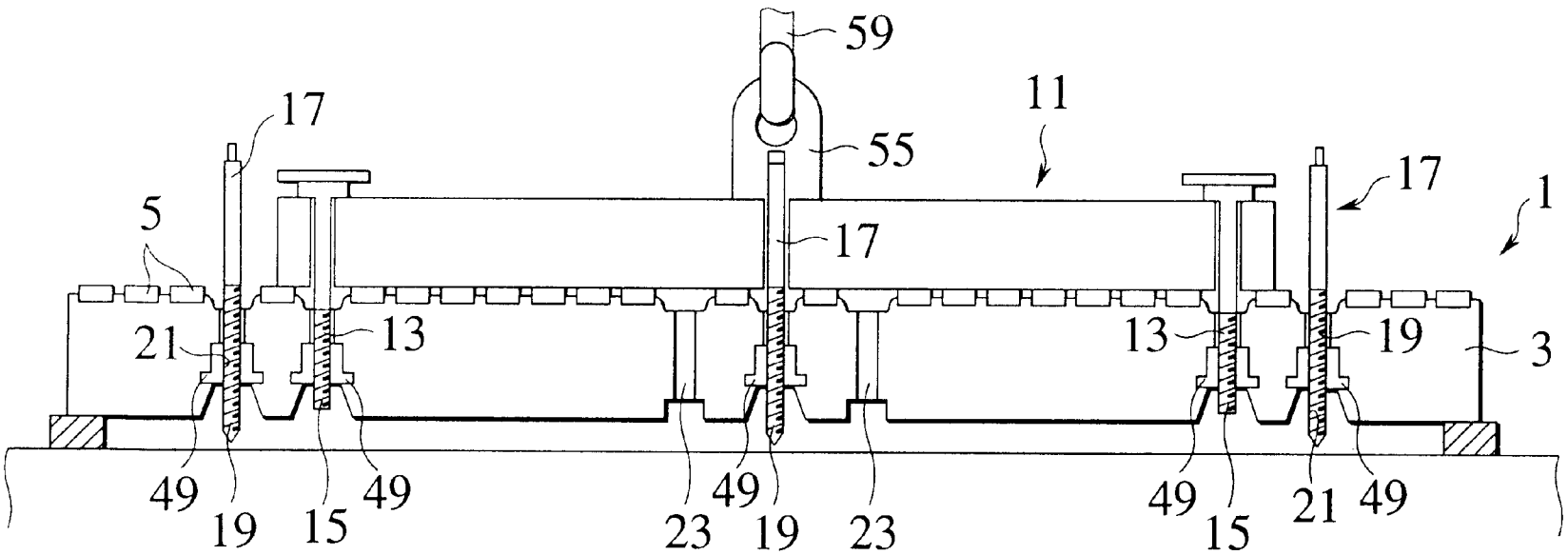
FIG. 7 is a sectional view in which a jig for lifting up a concrete block is mounted to the pavement.
Figure 8:
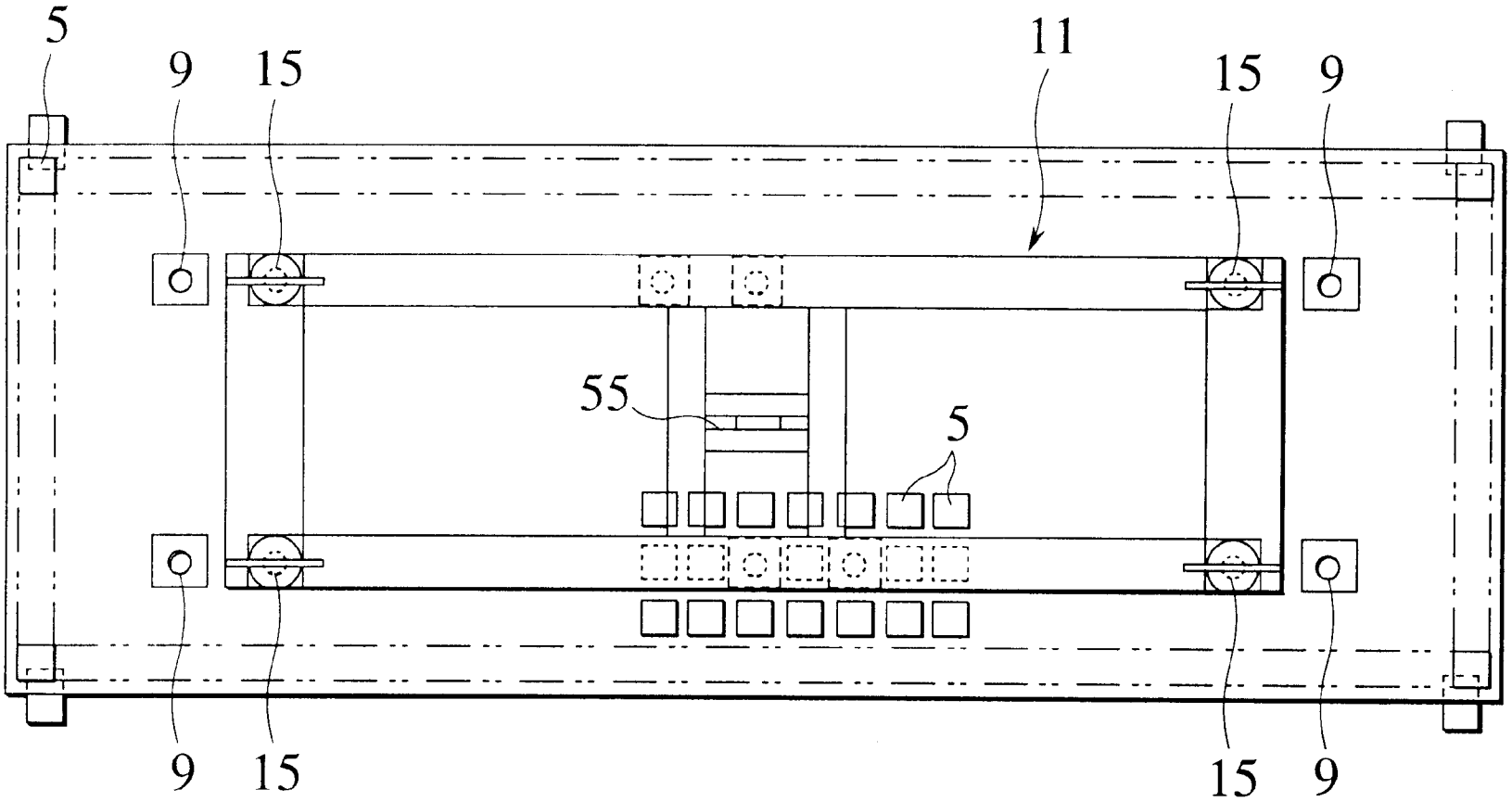
FIG. 8 is a schematic plan view in FIG. 7.

The first through holes 7 are provided in front portion two each (vertically in FIG. 2) and in rear portion two each (vertically in FIG. 2). Each of the first through holes 7 is formed with an internal thread 15 which is screwed into an external thread 13 of a jig 11 for lifting up the concrete block 3 as shown in FIG. 7.

The second through holes 9 are provided in front portion two each (vertically in FIG. 2), in center portion two each (vertically in FIG. 2) and in rear portion two each (vertically in FIG. 2). Each of the second through holes 9 has an internal thread 21 which is screwed into an external thread 19 of a jig 17 for adjusting a height of the concrete block 3 as shown in FIG. 7. Third through holes 23 for charging are provided side by side with the two second through holes 9 provided in center portion vertically.

Figure 11:
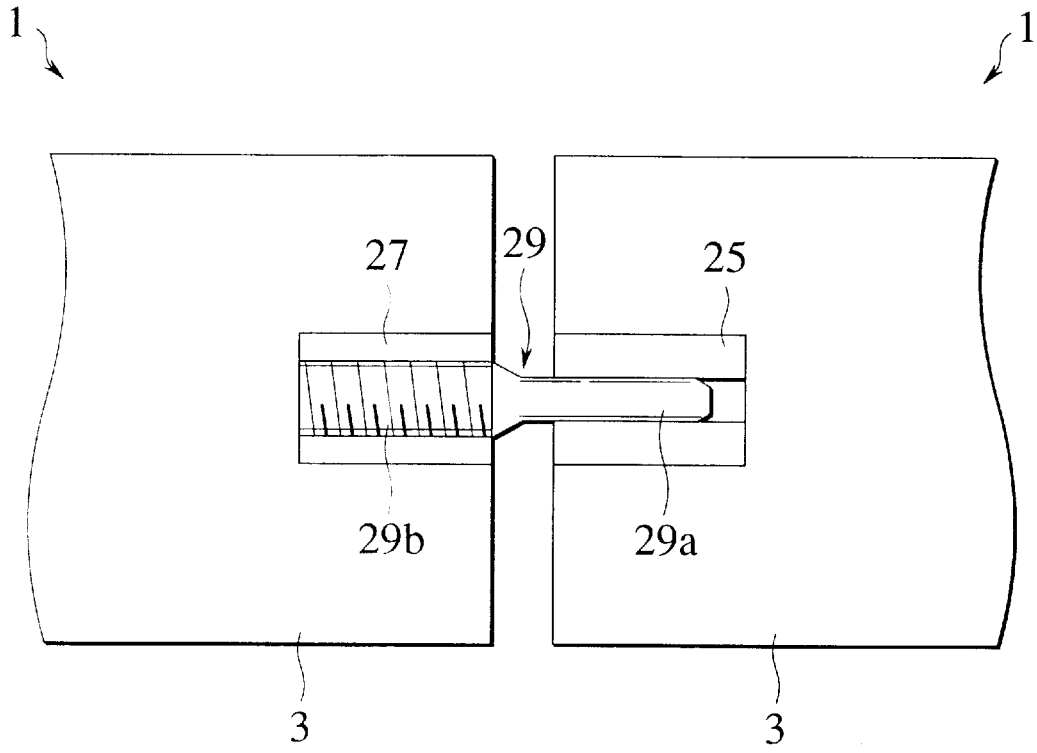
FIG. 11 is a sectional view showing a connecting state between a connecting member and a connecting metal fitting.

A pair of connecting members 25 and a pair of connecting members 27 are respectively provided on front and rear wall surfaces of the longitudinally long concrete block 3. Each of the front side connecting members 25 is formed into a connecting hole into which a connecting portion 29*a* of a connecting jig 29 is inserted as shown in FIG. 11. Each of the rear side connecting members 27 is formed into a screw hole into which a screw portion 29*b* of the connecting jig 29 is screwed.

The tiles 5 each having a slipping resistivity are arranged in order on the entire region of the upper surface of the concrete block 3 except the first, second and third through holes 7, 9 and 23, and are integrally secured to the upper surface of the concrete block 3.

Next, the way to form the pavement 1 will be explained.

Figure 3:
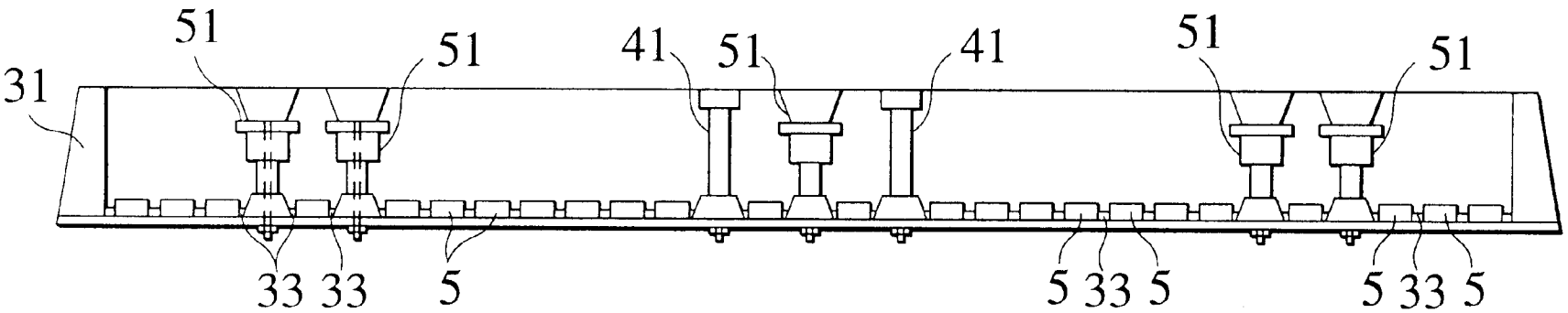
FIG. 3 is a sectional view in which a jig is set to a frame.
Figure 4:
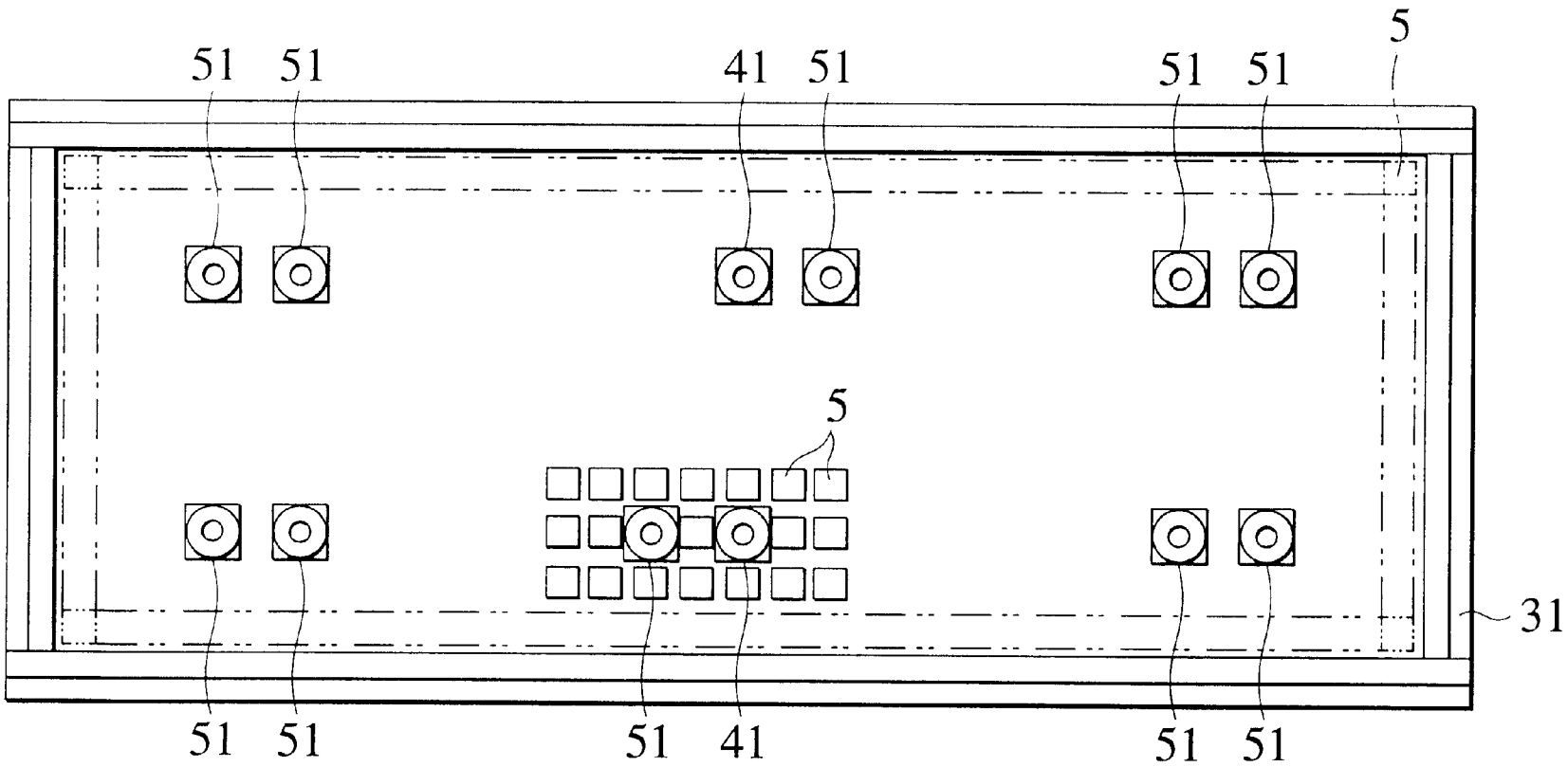
FIG. 4 is a schematic plan view o in FIG. 3.
Figure 5:
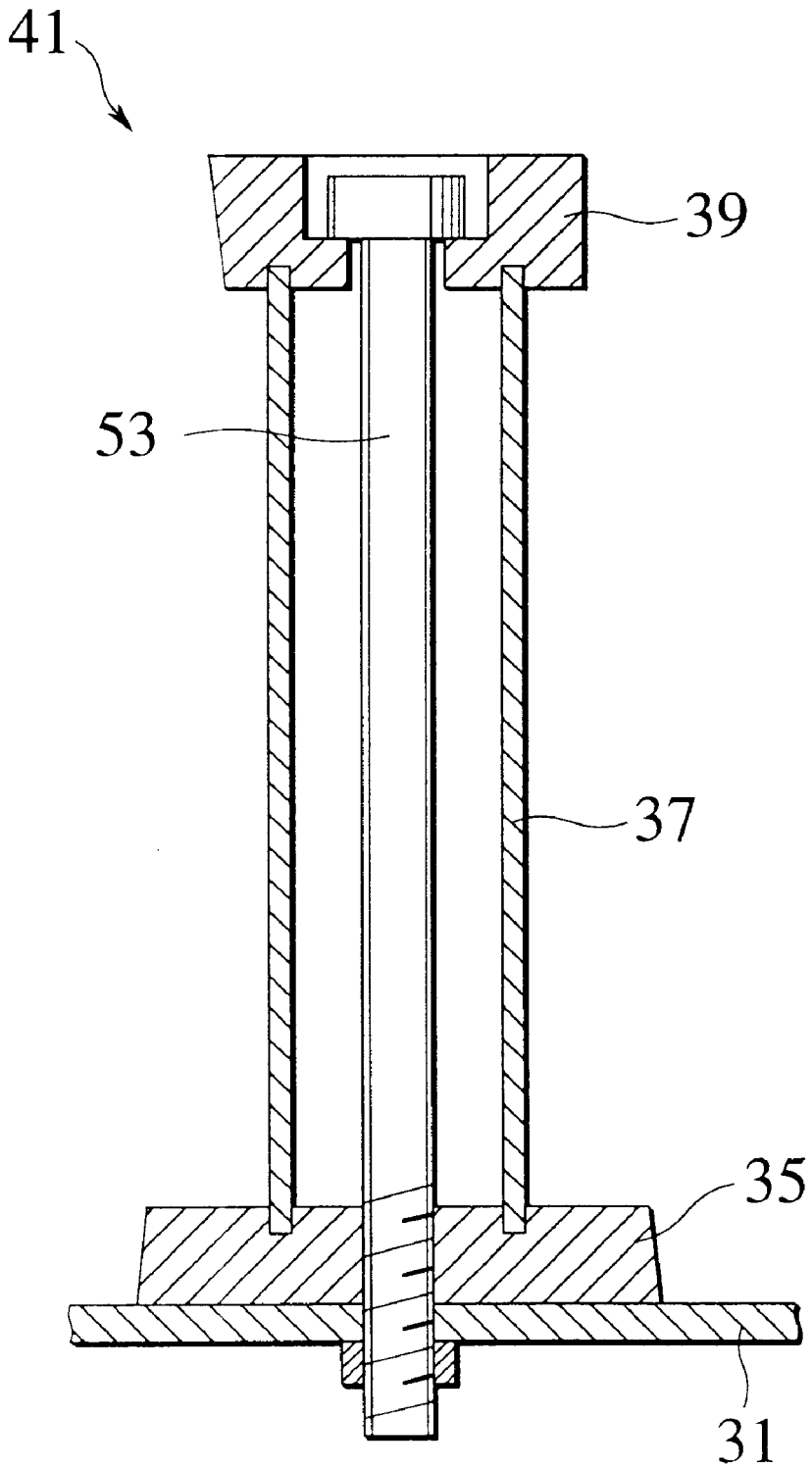
FIG. 5 is a sectional view showing a mounting state of a third jig for a through hole.
Figure 6:
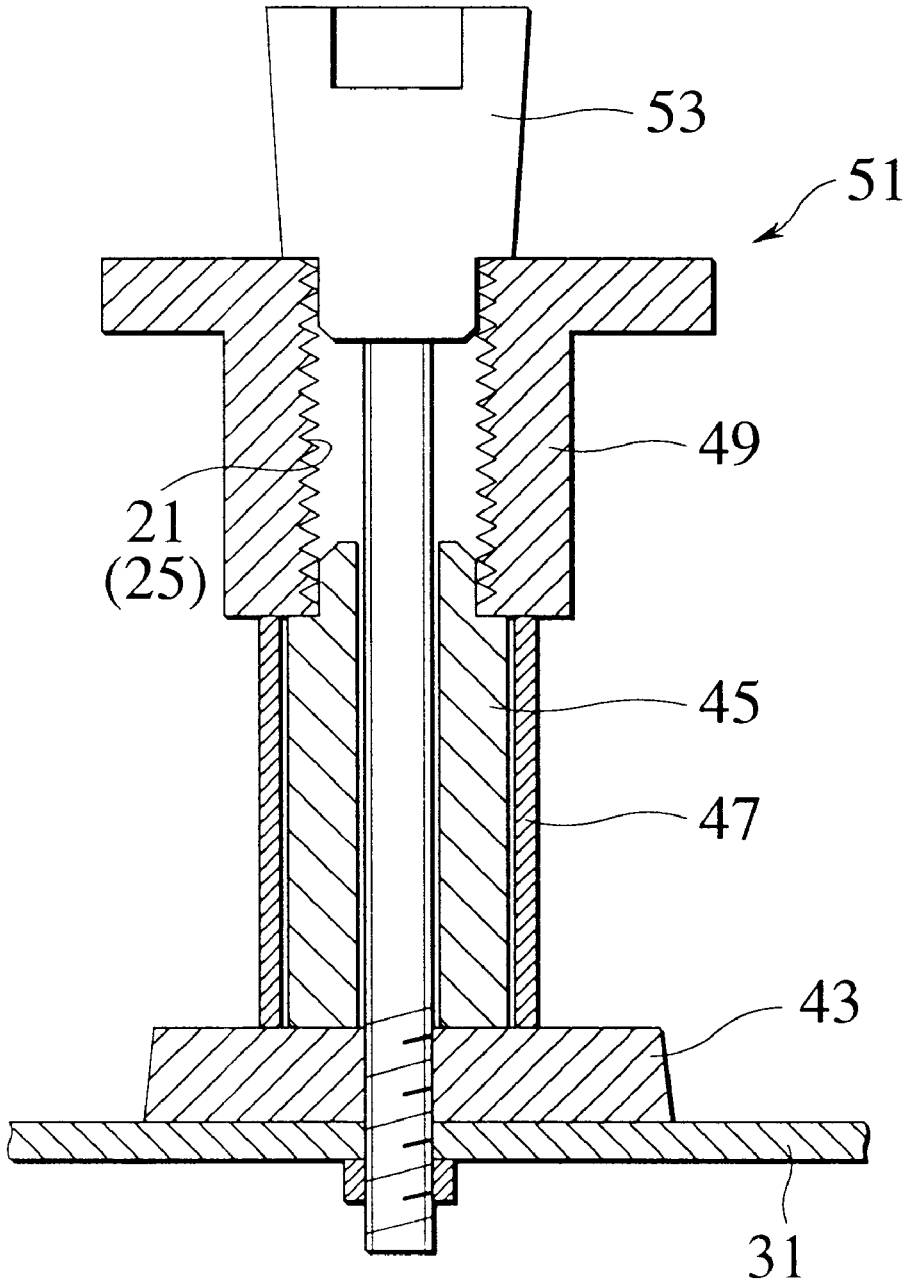
FIG. 6 is a sectional view showing a mounting state of first and second jigs for through holes.

As shown in FIGS. 3 and 4, the tiles 5 are arranged in order on a bottom in a frame 31 except portions corresponding to the connecting members 25 and 27 as well as the first, second and third through holes 7, 9 and 23, and joint adjusting materials 33 are pushed between the tiles 5. Next, a jig 41 for the third through hole comprising a false tile 35, a pipe 37 for a hole and a lid 39 as shown in FIG. 5 is set to the frame 31 by a bolt 53. A jig 51 for each of the first and second through holes comprising a false tile 43, a positioning member 45, a pipe 47 and an internal thread metal fitting 49 which is formed at its inner side with an internal thread 21, 25 is set to the frame 31 by a bolt 53. Then, cement is charged into the frame 31. After the cement has been hardened, the jigs 51 for the first and second through holes and the jig 41 for the third through hole are removed except the frame 31 and the internal thread metal fitting 49 so that the pavement 1 is formed.

The procedure for paving the pavement 1 structured as described above on the test course road will be explained below.

First, the pavement 1 is transported to a construction site. In this case, since the pavement 1 is formed into the unit-type concrete block 3, the pavement 1 can be loaded on a truck or the like, and easily transported to the destination.

Next, as shown in FIG. 7, the external threads 19 of the jig 17 for adjusting a height of the concrete block 3 are screwed to, passing through and projecting from, from above, the internal threads 21 of the second through holes 9 formed in the front, center and rear six portions of each of the pavements 1 transported to the construction side. At that time, tip ends of the external threads 19 are projected uniformly.

Figure 9:
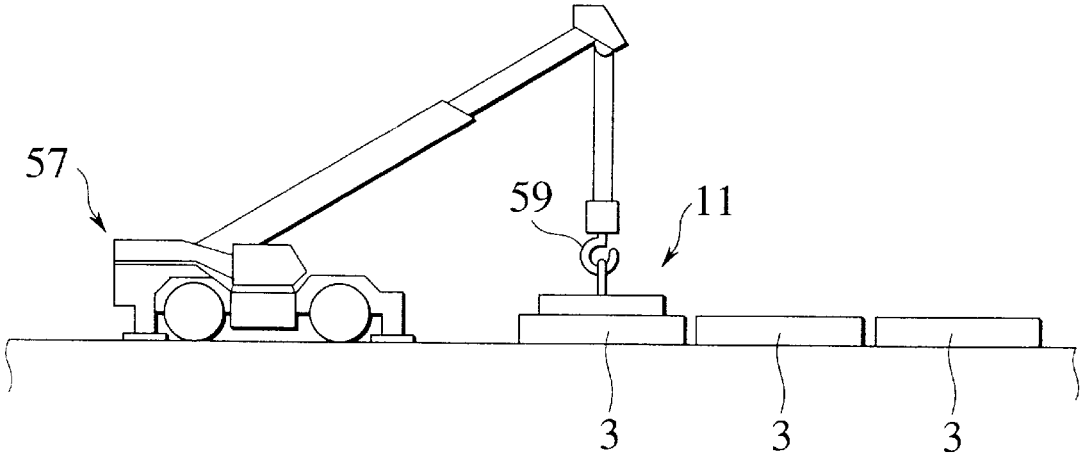
FIG. 9 is an explanatory view showing a paved state of the pavement.

Next, the external threads 13 for the jig 11 for lifting up the concrete block 3 are screwed into the internal threads 15 for the first through holes 7 formed in the front and rear four positions of the pavement 1 in which the jig 17 for adjusting a height of the concrete block 3 is set, and are fixedly set. A lift portion 55 of the jig 11 for lifting up the concrete block 3 which is fixedly set is lifted up by a hook 59 of a crane truck 57 as shown in FIG. 9, and is temporarily paved on a road surface which is to be a test course road.

Figure 10:
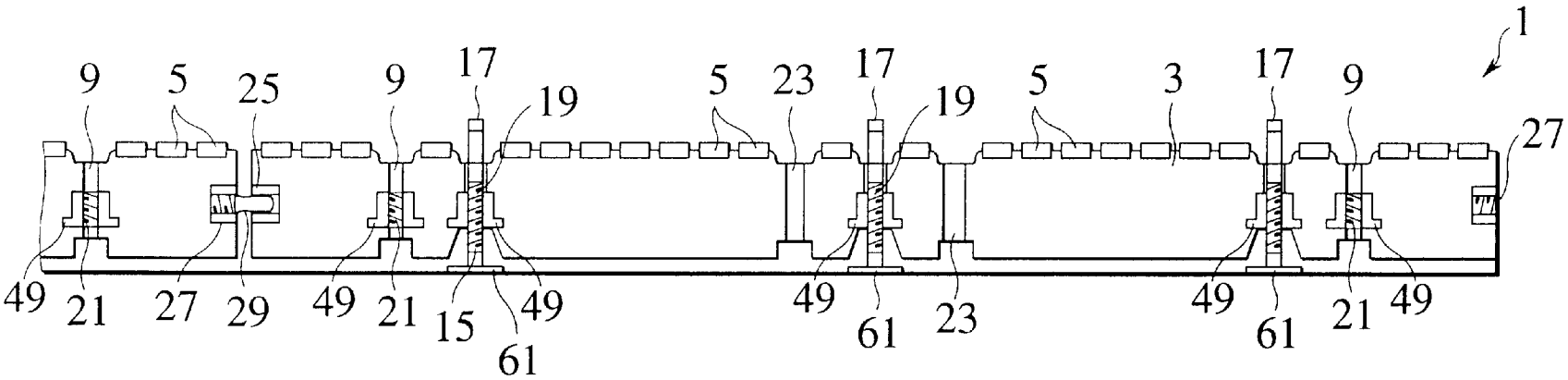
FIG. 10 is a sectional view of each of the pavements when they have been paved.

After the concrete block 3 has been temporarily paved, as shown in FIG. 10, the jig 11 for lifting up the concrete block 3 is removed from the pavement 1, and the removed jig 11 is fixedly set in the next pavement 1 which is standing by. The fixedly set jig 11 for lifting up the concrete block 3 is lifted by the crane truck 57, and is temporarily paved repeatedly so that the pavements 1 are sequentially paved. In this case, the pavement 1 can be easily lifted without requiring the hanging operation, and is temporarily paved, the operation efficiency for temporarily paving the pavement 1 is enhanced.

As shown in FIG. 10, the tip ends of the external threads 19 of the jig 17 for adjusting a height of the concrete block 3 made at the front, center and rear six portions of the pavement 1 are contacted with a plate 61 which is previously arranged on the road surface, so that the temporarily arranged pavement 1 is supported substantially horizontally with a space d in which a filler is charged between the pavement 1 and the road surface.

When the horizontally supported pavement 1 is inclined after the temporary arrangement, the projecting amount of the external thread 19 of the jig 17 for adjusting a height of the concrete block 3 at that inclined portion is controlled, and the inclination can easily be corrected by positioning the pavement 1 horizontally.

Therefore, as compared with means in which the height adjusting bolt is screwed and projected until the bolt abuts against the road surface after the temporary arrangement, and the horizontal state of the pavement 1 is secured by adjusting the projecting amount, the temporary arranging operation of the pavement 1 is swiftly completed.

In the temporarily paved pavements 1 and 1, as shown in FIG. 11, the screw portion 29*b* of the connecting metal fitting 29 is screwed in the screw hole of the connecting member 27, and the connecting portion 29*a* of the connecting metal fitting 29 is inserted into the connecting member 25 of the other pavement 1, so that the concrete blocks 3 and 3 are connected to each other.

Figure 12:
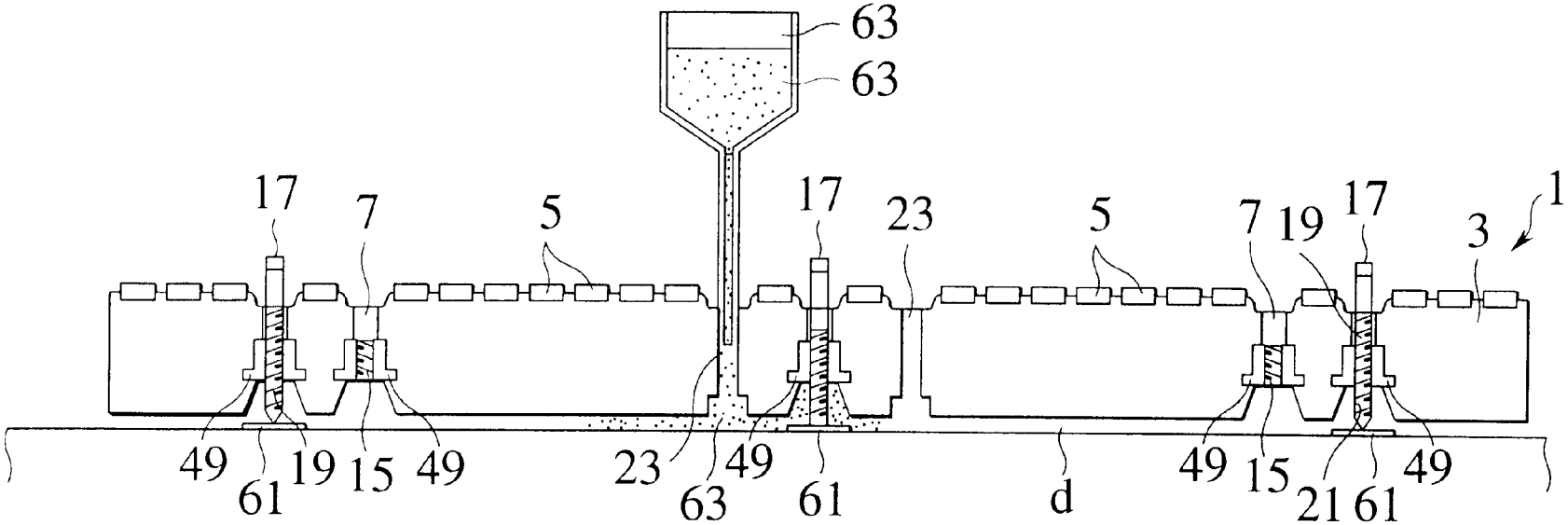
FIG. 12 is an explanatory view of operation for charging a filler.

Next, as shown in FIG. 12, a charging container 63 is inserted into one of the total four first through holes 7 formed in the front and rear portions two each, and the total two third through holes 23 formed in the center portions, and a filler material 63 such as cement is charged. At that time, the first through hole 7 into which the filler has not yet been charged is observed, and the operation is proceeded while confirming that the filler material 63 is sufficiently charged into the space d between the road surface and the concrete block 3.

Figure 13:
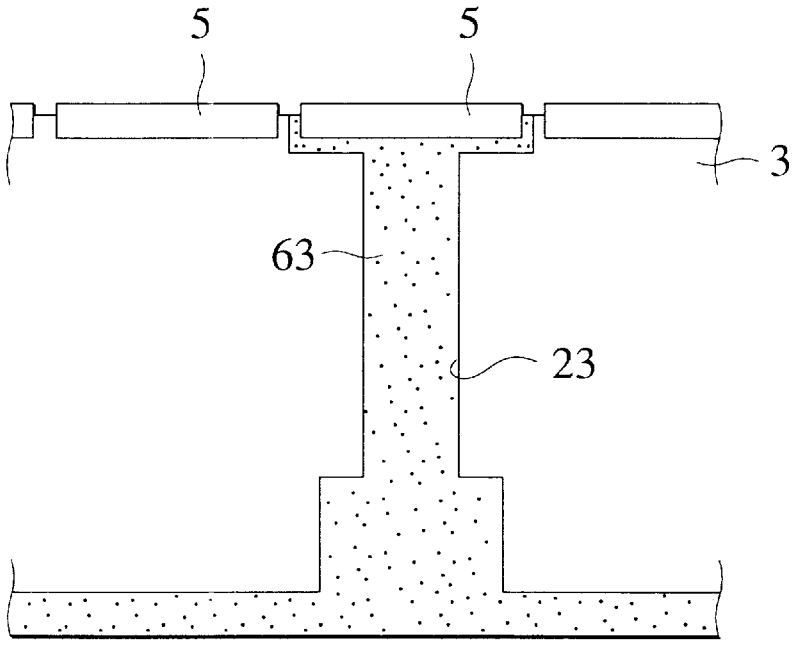
FIG. 13 is a sectional view in which an upper surface of a third through hole is covered with a tile.
Figure 14:
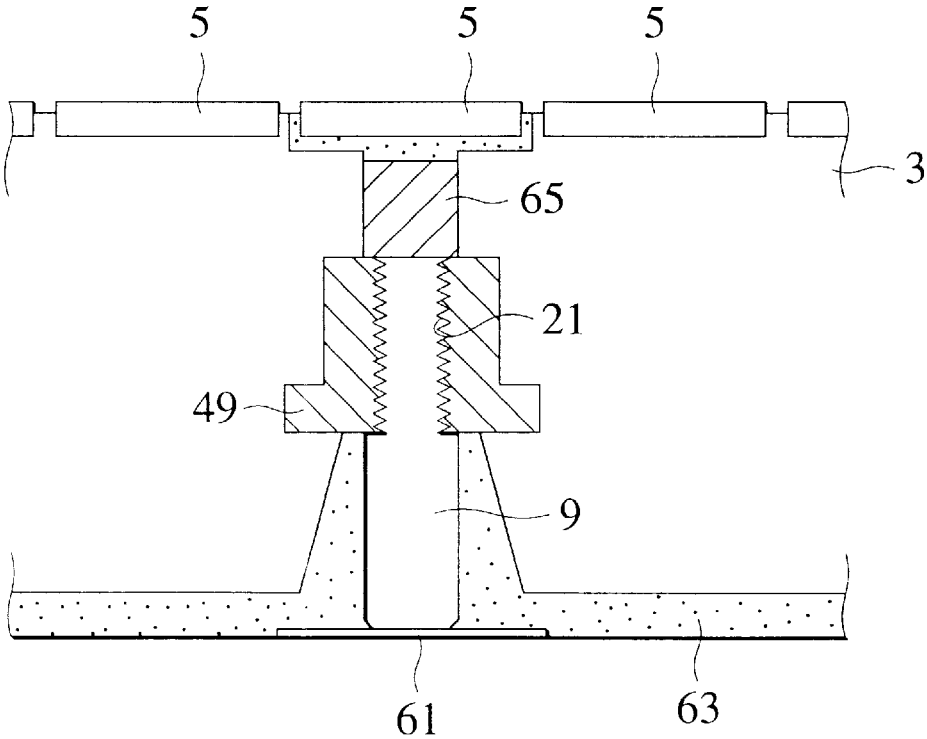
FIG. 14 is a sectional view in which an upper surface of a second through hole is covered with a tile.

After the filler 63 has been completely charged up to the upper portion of the first through hole 7, the charging container 63 is moved to the through hole 7 or 23. These operation is repeated sequentially. Next, after the filler 63 has been hardened, the jig 17 for adjusting the height of the concrete block 3 is removed. The upper surfaces of the first, second and third through holes 7, 9 and 23 are closed by tiles 5 as shown in FIGS. 13 and 14, and the operation is completed.

With the above operations, the a test course road having uniform set precision can be obtained.

As described above, according to the pavement 1 of the present embodiment, since the pavement 1 is of a transportable unit structure comprising the concrete block 3, the pavement 1 can be easily transported to the construction site by a truck and the like.

The pavement 1 can easily be lifted by the crane truck 57 using the jig 11 for lifting the concrete block 3 without requiring the hanging operation, and is temporarily paved. Therefore, the operation efficiency for temporarily paving the pavement 1 is enhanced.

When the pavement 1 transported to the construction site is temporarily arranged on the road surface, since the pavement 1 can be supported substantially horizontally with a space for charging the filler material between the road surface and the pavement 1 by the previously set jig 17 for adjusting the height of the concrete block 3, the temporary arranging operation by which the pavement 1 is positioned substantially horizontally is swiftly completed and therefore, the operation efficiency is largely enhanced.

Further, even if the pavement is inclined from the horizontal state after the temporary arranging operation, it is possible to easily correct the inclination by adjusting the jig 17 for adjusting the height of the concrete block 3.

Although the upper surface of the second through hole 9 after the jig 17 for adjusting the height of the concrete block 3 is removed is closed by a stopper 65, the filler material 63 may be charged into the second through hole 9 and the upper surface of the second through hole 9 may be closed by the tile 5.

What is claimed is:

1. A pavement body for a road, comprising:

a pavement block having a lower surface facing an unpaved surface of the road, an upper surface opposite the lower surface, a central portion, a first side portion adjacent to the central portion, a second side portion adjacent to the central portion and opposite the first side portion, and a side through hole extending from the upper surface to the lower surface in each of the first and second side portions;

a lifting member removably fixed on the upper surface in the central portion of the pavement block, wherein the lifting member is lifted with the pavement block; and side height adjustment jigs screwed in each side through hole that project from the lower surface of the pavement block, wherein the side height adjustment jigs establish a first height of the lower surface of the pavement block above the unpaved road surface and enable adjustment of the first height of the lower surface of the pavement block above the unpaved road surface.

2. A pavement body for a road according to claim 1, further comprising:

a center through hole extending from the upper surface to the lower surface in the central portion of the pavement block; and a center height adjustment jig screwed in the center through hole that passes through the lifting member and projects from the lower surface of the pavement block, wherein the center height adjustment jig establishes a second height of the lower surface of the pavement block above the unpaved road surface, and wherein the center height adjustment jig enables adjustment of the second height of the lower surface of the pavement block above the unpaved road surface.

* * * * *